United States Patent [19]

Kaneko et al.

[11] Patent Number: 4,561,381

[45] Date of Patent: Dec. 31, 1985

[54] VOLTAGE-CONTROLLED DEVELOPING DEVICE

[75] Inventors: Toshio Kaneko; Koji Sakamoto, both of Tokyo; Fuchio Kanno; Wataru Yasuda, both of Yokohama, all of Japan

[73] Assignee: Ricoh Company, Ltd., Tokyo, Japan

[21] Appl. No.: 564,245

[22] Filed: Dec. 21, 1983

[30] Foreign Application Priority Data

Dec. 24, 1982 [JP] Japan ..... 57-225973

[51] Int. Cl.[4] ..... G03G 15/06

[52] U.S. Cl. ..... 118/652; 118/653; 355/3 DD

[58] Field of Search ..... 355/3 DD, 14 D, 3 CH, 355/14 CH, 3 R, 14 R; 118/657, 658, 647, 651, 652, 653, 656, 639, 640; 430/102, 108, 120, 122, 125, 100, 45, 54

[56] References Cited

U.S. PATENT DOCUMENTS 4,377,332 3/1983 Tamura ..... 355/3 DD
4,406,535 9/1983 Sakamoto et al. ..... 355/14 D X
4,406,536 9/1983 Suzuki et al. ..... 355/14 D X
4,422,749 12/1983 Hoshino et al. ..... 355/3 DD
4,423,950 1/1984 Sagami ..... 355/3 DD X
4,445,771 5/1984 Sakamoto et al. ..... 355/14 D X

*Primary Examiner*—R. L. Moses

*Attorney, Agent, or Firm*—Cooper, Dunham, Clark, Griffin & Moran

[57] ABSTRACT

A device for developing an electrostatic latent image formed on an imaging surface by applying a thin film of uniformly charged magnetic toner includes a sleeve which is driven to rotate at constant speed in an intended direction, a hopper for supplying toner to said sleeve, a pressure blade pressed against the sleeve to form the thin film of charged toner on the sleeve and a discharging scraper provided with a plurality of holes and disposed in contact with the sleeve at a location downstream of the developing region, whereby remaining toner on the sleeve is scraped off the sleeve and returned to the sleeve after passing through the holes, to thereby have the charge remaining on the sleeve removed by the discharging scraper.

9 Claims, 5 Drawing Figures

VOLTAGE-CONTROLLED DEVELOPING DEVICE

BACKGROUND OF THE INVENTION

1. Field of the Invention

This invention generally relates to a device for developing an electrostatic latent image by applying a single-component developer thereto, and particularly to a device for developing an electrostatic latent image formed on an imaging surface such as the surface of a photosensitive member in electrophotography.

2. Description of the Prior Art

In imaging machines such as electrophotographic copying machines and electrostatic recording machines often used in facsimiles and printers, use is normally made of a device for developing an electrostatic latent image and thereby converting the latent image into a visible image. In such a developing device, different developing characteristics are normally required depending upon the kind of originals, i.e., whether they are line images such as characters or area images such as pictures. FIG. 1 is a graph showing desired developing characteristics, wherein the abscissa is taken for the image density of original image and the ordinate is taken for the image density of copy image. In FIG. 1, the desired developing characeristic for area images is indicated by the solid line A and the desired developing characteristic for line images is indicated by the dotted line B. As indicated, the desired developing characteristic B for line images has a steeper rising slope as compared with the slope of the desired developing characteristic A for area images because it is normally desired to increase the image density of copy image even if the original image has a relatively lower density in the case where the original image is a line image, thereby increasing contrast and clarity of image, but this is not true in the case of area image original, as a copy image is normally desired to have the density which corresponds to that of the original in the case where the original is an area image.

In order to increase the image density of copy image in the case where the original is a line image, the so-called edge effect has been conventionally used. That is, since the electric field strength is higher at the image periphery than at the central region of the image, more toner is attracted at the image periphery, thereby causing the edge effect. Thus, in the case of a line image in which the area of image is relatively small, the image itself is mostly formed by its peripheral regions, so that the image as a whole receives the edge effect, thereby producing a developed image of increased density. If use is made of a so-called two-component developer comprised of toner and carrier beads, the above edge effect may be obtained sufficiently. However, there has been difficulty in obtaining a sufficient edge effect when using a so-called single-component developer.

Furthermore, when using magnetic toner, which is an example of single-component developer, to develop an electrostatic latent image, it is often the case that the magnetic toner is first formed into a thin film while uniformly charged to a predetermined polarity as magnetically attracted onto a toner transporting member, and as the toner transporting member advances along a predetermined path, a thin film of charged toner formed thereon is transported past a developing region where the toner is selectively attracted to the latent image electrostatically to have the latent image developed. As this process is repeated, charge becomes gradually accumulated at the surface of the toner transporting member due, for example, to friction with toner. The charge thus accumulated provides a bias effect to the electrostatic latent image to be developed, and, as a result, a negative phantom image will be formed as superposed on the resulting developed image. This is because, since the charge of opposite polarity remains in those portions of the surface of the toner transporting member which correspond to the image area and thus have been developed in the previous cycle, if those portions again correspond to the image area in the next following cycle, the potential of latent image in those portions becomes lowered, thereby decreasing the image density in those regions which in turn causes a phantom image.

It is thus important to take measures to prevent the above-described charge accumulation from occurring and to maintain the potential level at the surface of the toner transporting member constant at all times.

SUMMARY OF THE INVENTION

Therefore, it is a primary object of the present invention to obviate the above-described disadvantages of the prior art.

Another object of the present invention is to provide an improved developing device employing magnetic toner for developing an electrostatic latent image.

A further object of the present invention is to provide a developing device capable of providing the desired developing characteristics depending upon whether the original is a line image or an area image with the use of magnetic toner.

A still further object of the present invention is to provide a developing device capable of preventing the occurrence of charge accumulation in the toner transporting member in a repetitive cycle.

A still further object of the present invention is to provide a developing device simple in structure and thus easy to manufacture.

Other objects, advantages and novel features of the present invention will become apparent from the following detailed description of the invention when considered in conjunction with the accompanying drawings.

DESCRIPTION OF THE PREFERRED EMBODIMENTS

Figure 2:
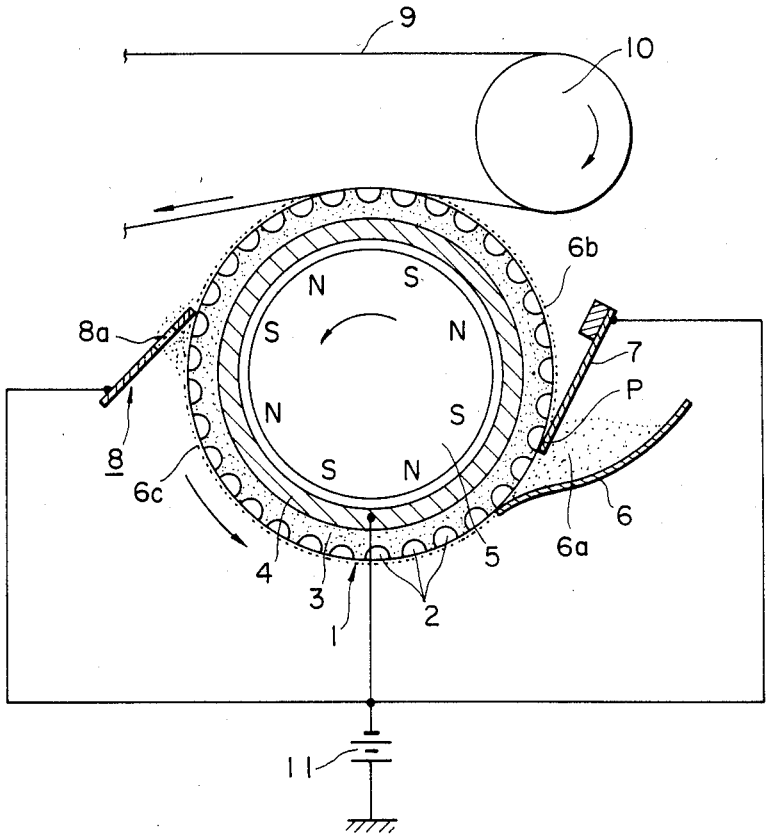
FIG. 2 is a schematic illustration showing a developing device constructed in accordance with one embodiment of the present invention.

Referring now to FIG. 2, there is shown a developing device using magnetic toner as a developer, which is constructed in accordance with one embodiment of the present invention. As shown, the developing device is disposed to be in contact with a photosensitive belt 9 comprised of an endless belt of electrically conductive material and a photoconductive layer formed on the endless belt. The photosensitive belt 9 is passed around a roller 10 which is driven to rotate in the direction indicated by the arrow, and, thus, the belt 9 is caused to advance in the direction indicated by the arrow.

The developing device includes a developing sleeve 1 which is rotatably supported and driven to rotate at constant speed in the direction indicated by the arrow, so that the developing sleeve 1 is in rolling contact with the outer surface of the photosensitive belt 9 thereby defining a developing region D.

In the illustrated embodiment, the developing sleeve 1 serving as a toner transporting member includes a cylindrical base 4 of electrically conductive material, a dielectric layer 3 formed on the outer peripheral surface of the cylindrical base 4 and a plurality of fine electrodes 2 provided as dispersed in the surface of the dielectric layer 3 and spaced apart one form another. Each of these fine electrodes 2 is, for example, made of an electrically conductive material such as metal, preferably copper. In manufacture, metal particles having the average diameter of approximately 100 microns are first provided as buried in the outer surface of the dielectric layer 3 and then the outer peripheral surface of the dielectric layer 3 is ground to provide a smooth outer peripheral surface thereby having the buried metal particles partly exposed at the resulting peripheral surface spaced apart one from another. Thus, the metal particles 2 constitute floating electrodes which are electrically insulated one from another and from the cylindrical base 4.

In addition, the outer peripheral surface of the developing sleeve 1 is preferably processed to have a predetermined roughness in the order of a few microns so as to aid in forming a thin film of toner uniformly thereon. Inside of the developing sleeve 1 is disposed a columnar magnet 5 which is rotatably supported to be coaxial with the developing sleeve 1, and, in the illustrated example, the magnet 5 is driven to rotate in the same direction as that of the sleeve 1. Preferably, the magnet 5 is driven to rotate at approximately 1,500 r.p.m. in the direction indicated by the arrow; however, it may be fixedly provided or driven to rotate in the opposite direction, if necessary. The cylindrical base 4 is connected to a negative bias voltage 11 in the illustrated example.

As mentioned earlier, the developing sleeve 1 is in rolling contact with the photosensitive belt 9 and a developing region D is defined as a region where they are located close together or in contact. Upstream of the developing region D is disposed a hopper 6 storing therein a quantity of magnetic toner **6*a*, which supplies toner 6*a* to the outer peripheral surface of the developing sleeve 1 as magnetically attracted thereto by the columnar magnet 5. The magnetic toner 6*a*** includes magnetic powder and a resin, and it is comprised of magnetically attractable and highly electrically insulative particles having the average diameter of approximately 6 microns and the true specific weight of approximately 1.86.

Downstream of the hopper 6 and upstream of the developing region is disposed a pressure blade 7 comprised, for example, of a spring plate of magnetic material having the thickness of approximately 0.1 mm and sufficient resiliency. The pressure blade 7 extends across the full width and in sliding contact with the outer peripheral surface of the developing sleeve 1. It is to be noted that when the pressure blade 7 is comprised of a magnetic material, the blade is preferably pivotally supported at its top end so that the blade 7 is kept pressed against the outer peripheral surface of the sleeve 1 as magnetically attracted by the magnet 5. However, if the blade 7 is so disposed to be in pressure contact with the sleeve 1 when mounted in position, it is not by all means necessary to make the blade of a magnetic material. At any rate, since the blade 7 is kept in pressure and sliding contact with the outer peripheral surface of the developing sleeve 1, the toner **6*a* supplied to the outer peripheral surface of the sleeve 1 becomes pressed and regulated in amount between the pressure blade 7 and the sleeve 1 so that a thin film 6*b* of toner having a predetermined thickness is formed on the outer peripheral surface of the sleeve 1 while being charged to a predetermined polarity. The pressure blade 7 is also connected to the negative bias source 11 and thus maintained at the same potential as that of said cylindrical base 4**.

Figure 3:
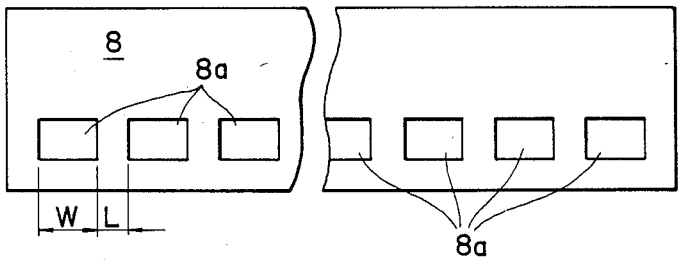
FIG. 3 is a schematic illustration showing in plan view a discharging scraper 8 employed in the developing device of FIG. 2.

Downstream of the developing region D with respect to the rotational direction of the developing sleeve 1 is disposed a discharging scraper 8 for removing the residual charge mainly from the sleeve 1. The discharging scraper 8 is comprised of an elastic member of magnetic and electrically conductive material having the thickness of approximately 0.15 mm and is similar to the pressure blade 7. As shown in FIG. 3, the scraper 8 is generally rectangular in shape and provided with a plurality of windows **8*a* at a predetermined pitch along the bottom side edge thereof. As illustrated in FIG. 3, the windows are so dimensioned that the representative size W is much larger than the spacing L between the two adjacent windows. Although the illustrated embodiment includes rectangularly-shaped windows, they may take any other appropriate shape, if desired. The discharging scraper 8 is disposed with its bottom side edge, the side edge along which the windows 8*a* are provided, in scrubbing or sliding contact with the outer peripheral surface of the developing sleeve 1 across its full width. Thus, the toner remaining on the outer peripheral surface of the developing sleeve 1 after the developing step is forcibly scraped off the outer peripheral surface of the developing sleeve 1. The toner thus scraped off is then mixed together sufficiently due to the relative motion between the sleeve 1 and the scraper 8 and then transported through the windows 8*a* to be again deposited onto the outer peripheral surface of the sleeve 1. At this time, since the width W of each window 8*a* is much larger than the spacing L between the two adjacent windows 8*a*, 8*a***, clogging or stagnation of toner is prevented from occurring.

It is to be noted that, similarly to the pressure blade 7, the scraper 8 is preferably made of a magnetic material as mentioned earlier and it is disposed with its top end pivotally supported, whereby the scraper may be brought into pressure contact with the outer peripheral surface of the sleeve 1 as magnetically attracted by the magnet 5 disposed inside of the sleeve 1. Such a structure is quite advantageous because it provides a self-adjusting mechanism for keeping the level of pressure force acting between the scraper 8 and the sleeve 1 at optimum at all times. However, if the scraper 8 is disposed to be in pressure contact with the outer peripheral surface of the sleeve 1 by means of a spring or by its own resiliency when properly set in position, then it may be made of any material other than a magnetic material.

In the illustrated embodiment, the discharging scraper 8 is also connected to the negative bias source 11 and thus maintained at the same potential as that of said cylindrical base 4 similarly with the pressure blade 7. The scraper 8 may be connected to ground rather than to the negative bias source 11, and, in this case, the residual charge on the sleeve 1 may be removed through the scraper 8 efficiently. In this case, however, since a voltage difference will be created between the sleeve 1 and the scraper 8, charge may be injected to the residual toner on the sleeve 1 which could then cause background contamination in the resulting image. If the bias voltage is increased to eliminate such a voltage difference, electrostatic contrast may be lost, thereby lowering the image density. Thus, care must be exercised in the case when the scraper 8 is connected to ground. On the other hand, with the structure shown in FIG. 2, removal of residual charge not only from the sleeve 1 but also from the scraper 8 may be carried out most efficiently without causing any image deteriorations such as background contamination.

Figure 4:
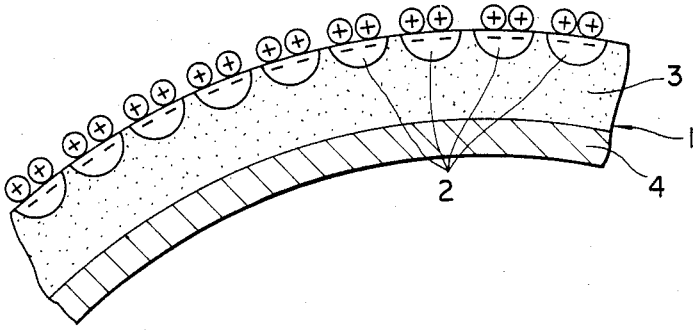
FIGS. 4 and 5 are schematic illustrations showing part of a developing sleeve employed in the developing device of FIG. 2 which are useful for explaining how the charge may be accumulated at the surface of the developing sleeve.

In operation, the magnetic toner 6*a* is supplied from the hopper 6 to the outer peripheral surface of the developing sleeve 1 as magnetically attracted thereto by means of the magnet 5. The toner 6*a* thus attracted to the sleeve 1 is then transported along a circular path defined by the outer peripheral surface of the sleeve 1 as the sleeve 1 is driven to rotate to a toner film regulating region P where the toner 6*a* attracted to the sleeve 1 becomes pressed between the sleeve 1 and the pressure blade 7, thereby forming the thin film 6*b* of uniformly charged toner on the outer peripheral surface of the sleeve 1. The toner is charged to a predetermined polarity depending upon the relation of triboelectric series between the materials forming the toner, pressure plate 7 and the sleeve 1. In the illustrated embodiment, it is assumed that the toner is negatively charged and the sleeve receives positive charge at its outer peripheral surface. In this case, it is to be noted that the floating electrodes 2 mostly and selectively receive the negative charge, thereby serving as the charge sink. This condition is best illustrated in FIG. 4.

The thin film 6*b* of toner which has been formed into a predetermined thickness on the outer peripheral surface of the sleeve 1 and charged sufficiently as well as uniformly to a predetermined polarity is then transported to the developing region where the sleeve 1 is in rolling contact with the photosensitive belt 9 as the sleeve 1 is further driven to rotate. It is to be noted that various well-known image forming means, such as a means for uniformly charging the imaging surface and a means for exposing the thus charged imaging surface to a light image, are disposed along an imaging surface or outer peripheral surface of the photosensitive belt 9 and therefore an electrostatic latent image is formed on the imaging surface of the belt 9 when it enters the developing region. In case the latent image is formed by the negative charge, toner is selectively transferred to the latent image on the belt 9 from the thin film 6*b* on the sleeve 1 electrostatically, thereby having the latent image converted into a visible toner image.

Figure 1:
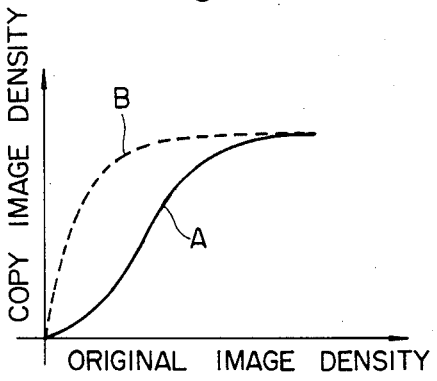
FIG. 1 is a graph illustrating desired developing characteristics wherein the solid line A is for area images and the dotted line B is for line images.

In this instance, since the floating electrodes 2 are provided at the surface of the developing sleeve 1 in a scattered arrangement, they serve substantially as the carrier beads in the conventional two-component developer, and, thus, the number of electric force lines emanating from the conductive base support, which is grounded, to the latent image through the floating electrodes 2 is increased to form a stronger electric field, thereby allowing to obtain the previously mentioned desired edge effect. Accordingly, the developing device of FIG. 2 allows to attain the ideal developing characteristics as shown in FIG. 1.

Figure 5:
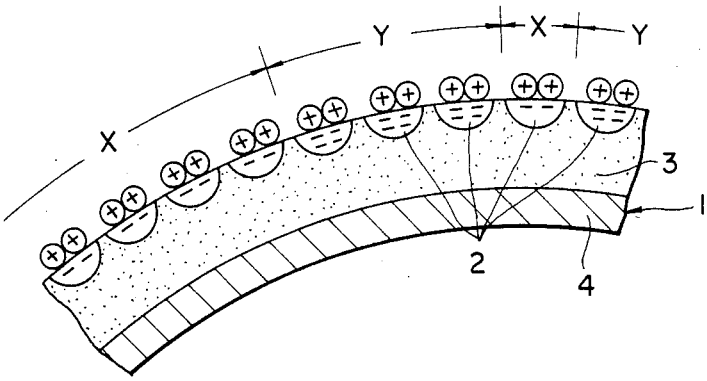

After developing the latent image as described above, there remains the negative charge on the outer peripheral surface of the developing sleeve 1 in those portions from where the toner has been transferred to the belt 9 corresponding to the latent image formed thereon. If the scraper 8 were not provided, then the outer peripheral surface of the sleeve 1 would be moved to the hopper 6 to receive a supply of toner 6*a* with the negative charge retained thereon. Then, the freshly supplied toner would be pressed between the sleeve 1 and the pressure blade 7 to be formed into a thin film while being triboelectrically charged to the positive polarity, thereby establishing the condition shown in FIG. 5. In this case, in a region Y where an image was formed in the previous cycle, the negative charge will be added to the residual negative charge, so that the amount of charge in this region Y becomes larger than that in the other region X where no image was formed in the previous cycle. As a result, due to the bias effect caused by the accumulated charge in the region Y, the image density in this region Y becomes decreased and a negative phantom image will be formed in the present cycle.

In view of this, in accordance with the present invention, the outer peripheral surface of the sleeve 1 is subjected to discharging operation by means of the discharging scraper 8 to remove any residual charge therefrom after the developing step, thereby allowing to prevent the occurrence of inconveniences such as production of phantom images. With the bottom end of the scraper 8, which is maintained substantially at the same bias potential as that of the base 4, being in sliding contact with the outer peripheral surface of the sleeve 1 at a predetermined pressure, the toner remaining on the sleeve 1 is once completely scraped off. With the residual toner thus scraped off, the bottom end of the scraper 8 comes into direct contact with the outer peripheral surface of the sleeve 1, so that any charge remaining on the sleeve 1, particularly in the floating electrodes 2, is removed by the scraper 8. At this time, since the outer peripheral surface of the sleeve 1 is preferably processed to a desired level of roughness or smoothness, the bottom end of the scraper 8 is capable of maintaining the intimate contact with the sleeve 1, thereby allowing to have the residual toner temporarily separated from the sleeve and to have any residual charge removed from the sleeve 1 as well as from the residual toner.

The toner thus scraped off the sleeve 1 is well mixed on the scraper 8 and then transported through the windows 8*a* and again deposited onto the outer peripheral surface of the sleeve 1. The toner thus deposited onto the sleeve 1 is transported as the sleeve 1 is further driven to rotate and mixed with the fresh toner supplied from the hopper 6. In this instance, since the floating electrodes 2 are properly discharged, the potential level at the outer peripheral surface of the sleeve 1 is uniform and there is no difference in potential level, which, in turn, contributes to prevent the production of phantom images. Besides, since the residual toner is once completely scraped off the sleeve 1 and mixed together before being deposited onto the sleeve 1 again, the formation of a thin film of uniformly charged toner is insured at all times, thereby allowing to obtain a developed image of high quality at all times.

While the above provides a full and complete disclosure of the preferred embodiments of the present invention, various modifications, alternate constructions and equivalents may be employed without departing from the true spirit and scope of the invention. For example, although magnetic toner was employed in the above embodiment, use may be also made of non-magnetic toner. Therefore, the above description and illustration should not be construed as limiting the scope of the invention, which is defined by the appended claims.

What is claimed is:

1. A device for developing an electrostatic latent image by applying toner thereto, comprising:

transporting means for transporting said toner along a predetermined path including a developing region where said latent image is developed;

supply means for supplying said toner to said transporting means;

toner film forming means disposed downstream of said supply means and upstream of said developing region with respect to the direction of movement of said transporting means for forming a film of said toner having a predetermined thickness and charge of predetermined polarity on said transporting means;

discharging means disposed downstream of said developing region and upstream of said supply means with respect to the direction of movement of said transporting means for removing residual charge at least from said transporting means; and bias means for applying a predetermined potential to said transporting means and said discharging means thereby maintaining said transporting means and said discharging means substantially at the same potential.

2. A device as in claim 1 wherein said bias means is also connected to apply said predetermined potential to said toner film forming means.

3. A device as in claim 1 wherein said transporting means includes a sleeve which is driven to rotate at constant speed in a predetermined direction.

4. A device as in claim 3 wherein said sleeve is comprised of a cylindrical base of electrically conductive material, a dielectric layer formed on the outer peripheral surface of said base and a plurality of floating electrodes provided in said dielectric layer spaced apart one form another and from said base.

5. A device as in claim 4 wherein said floating electrodes are provided as partly exposed over at least a portion of the outer peripheral surface of said dielectric layer.

6. A device as in claim 5 wherein said toner film forming means includes a blade which is generally rectangular in shape and is disposed to be pressed against said sleeve.

7. A device as in claim 6 further comprising a magnet disposed inside of said sleeve, wherein said blade is pivotally supported at one end and comprises a magnetic material and is magnetically attracted by said magnet to be pressed against said sleeve.

8. A device as in claim 7 wherein said discharging means includes a plate which is generally rectangular in shape and is provided with a plurality of holes along one side edge which is normally pressed against the outer peripheral surface of said sleeve, whereby remaining toner on said sleeve is scraped off said sleeve by said plate and returned to said sleeve after passing through said holes.

9. A device as in claim 8 wherein said plate is pivotally supported at the side opposite to said side along which said plurality of holes are provided, and wherein said plate comprises a magnetic material and is magnetically attracted by said magnet to be pressed against said sleeve.

* * * * *